US005500801A

United States Patent [19]

Löffler

[11] Patent Number: 5,500,801

[45] Date of Patent: Mar. 19, 1996

[54] DEVICE FOR COMPENSATING FOR DEVIATIONS IN REGISTER IN PRINTED PRODUCTS

[75] Inventor: Gerhard Löffler, Walldorf, Germany

[73] Assignee: Heidelberger Druckmaschinen AG, Heidelberg, Germany

[21] Appl. No.: 324,405

[22] Filed: Oct. 17, 1994

[30] Foreign Application Priority Data

Oct. 16, 1993 [DE] Germany ..... 43 35 351.7

[51] Int. Cl.[6] ..... B41F 5/06

[52] U.S. Cl. ..... 364/469; 364/471; 101/486; 101/DIG. 36

[58] Field of Search ..... 364/468, 469, 364/471; 101/180–181, 211, 485, 486, DIG. 36; 226/2, 3, 15–18, 27–29, 45

[56] References Cited

U.S. PATENT DOCUMENTS

| | | | |
|---|---|---|---|
| 4,546,700 | 10/1985 | Kishner et al. | 101/211 |
| 4,596,468 | 6/1986 | Simeth . | |
| 4,660,159 | 4/1987 | Ott . | |
| 4,690,051 | 9/1987 | Kishine et al. | 101/211 |
| 4,736,680 | 4/1988 | Wales et al. | 101/181 |
| 4,963,029 | 10/1990 | Kipphan . | |
| 5,076,163 | 12/1991 | Sainio | 101/181 |
| 5,126,578 | 6/1992 | Roch et al. | 101/181 |
| 5,138,667 | 8/1992 | Roch et al. . | |
| 5,181,257 | 1/1993 | Steiner et al. . | |
| 5,327,829 | 7/1994 | Miyoshi et al. | 101/180 |
| 5,331,890 | 7/1994 | Miyoshi et al. | 101/180 |

FOREIGN PATENT DOCUMENTS

| | | |
|---|---|---|
| 0143744 | 6/1985 | European Pat. Off. . |
| 0187125 | 7/1986 | European Pat. Off. . |
| 0221472 | 5/1987 | European Pat. Off. . |
| 3719766 | 7/1990 | Germany . |
| 4012608 | 7/1992 | Germany . |
| 4119824 | 12/1992 | Germany . |
| 1163067 | 6/1989 | Japan . |
| 327947 | 2/1991 | Japan . |

*Primary Examiner*—Roy N. Envall, Jr.
*Assistant Examiner*—Thomas E. Brown
*Attorney, Agent, or Firm*—Herbert L. Lerner; Laurence A. Greenberg

[57] ABSTRACT

Device for compensating for deviations in register in a printed product produced in a sheet-fed rotary printing press having a plurality of printing units includes at least one opto-electrical sensor device for detecting measured values from at least two image regions of a printed product; a computer/control device connected to the sensor device for receiving therefrom data regarding the measured values, for ascertaining from the data deviations in register between color separations caused by shrunken and/or swollen printing transferred to the printed product in the respective printing units, and for determining corresponding compensating adjustment data; and adjusting devices connected to the computer/control device for compensating for the deviations in register between the color separations in accordance with the determined adjustment data of the computation/control device; and method of compensating.

7 Claims, 7 Drawing Sheets

Fig. 5B

A

4 Calculation of register value differences after register correction $x' = x + \Delta x \qquad y' = y + \Delta y$

| | | | | |
|---|---|---|---|---|
| register | cross | 12.1 | $x_1' = 0,00$ | $y_1' = 0,00$ |
| " | " | 12.2 | $x_2' = 0,00$ | $y_2' = 0,02$ |
| " | " | 12.3 | $x_3' = 0,00$ | $y_3' = 0,00$ |
| " | " | 12.4 | $x_4' = 0,02$ | $y_4' = 0,00$ |
| " | " | 12.5 | $x_5' = -0,02$ | $y_5' = 0,00$ |

5 Calculation of the value of concave printing R $$R = \frac{(y_2'-y_1')+(y_2'-y_3')}{2} = \frac{(0,02-0,00)+(0,02-0,00)}{2} = 0,02$$

6 Determining the adjustment value $V_R$ for the sheet compensator 9 to compensate for concave printing

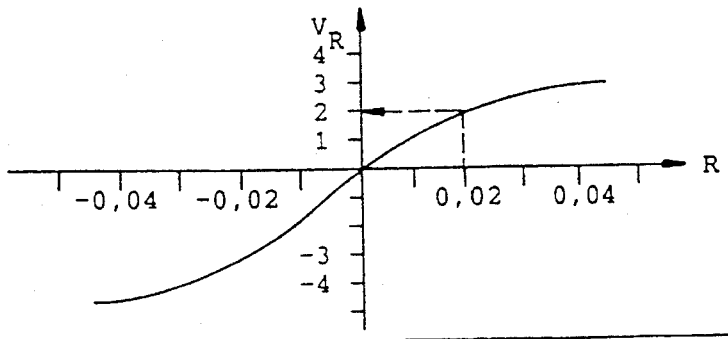

7 Calculation of the value of narrow printing E $$E = x_4' - x_5' = 0,02 + 0,02 = 0,04$$

B

Fig. 5C

B

8 Determining the adjustment value $V_E$ for the sheet compensator 9 to compensate for narrow printing

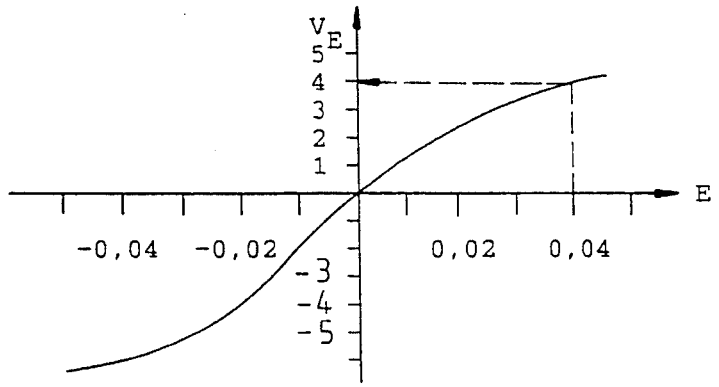

9 Calculation of a mean value from the adjustment values $V_R$ and $V_E$, when the concave printing and the narrow printing printing can be influenced with a setting adjustment by the sheet compensator 9

$$V = \frac{V_R + V_E}{2} = \frac{2 + 4}{2} = 3$$

10 Command to sheet compensator 9 for a setting adjustment $V_R = 2$ , $V_E = 4$ or alternatively $V = 3$

END

DEVICE FOR COMPENSATING FOR DEVIATIONS IN REGISTER IN PRINTED PRODUCTS

BACKGROUND OF THE INVENTION

Field of the Invention

The invention relates to a device for compensating for deviations in register in a printed product which, more particularly, is produced in a sheet-fed rotary printing press having a plurality of printing units.

Register errors appear in a multicolor printed product if the color separations in the various printing units are not transferred with proper coincidence or screening to the printed product or, in other words, in accordance with the screen pattern in the reproduction or repro-phase. The main source of error for deviations in registration is due to a relative shift in position of the printing plates on the plate cylinders of the individual printing units. To enable deviations in register between the various printing units to be compensated for, register adjusting devices are typically provided on the plate cylinders to permit the position of the printing plates in the circumferential and lateral direction to be corrected.

Deviations in register become negatively apparent in the printed image in two ways: first, they make the printed image blurry, and second, they cause changes in the color of the printed image.

In the final analysis, the quality of a printed product is judged by the human eye. The human eye has a very high capacity for resolution in terms of color variations. Even deviations in register of the order of magnitude of 10 μm result in intolerable color variations in the printed image. This numerical value offers some impression of the demands that effectively functioning register control and adjusting devices in printing presses must satisfy.

Register errors in the printed image cannot be solely ascribed, however, to incorrect positions or settings of the printing plates in the individual printing units. As a function of such parameters as the nature of the printing material to be printed on, dampening, pressure in the printing gap, and so forth, register errors, i.e., so-called narrower or shrunken printing and rounded or swollen printing, appear, especially in sheet-fed offset.

So-called shrunken printing occurs due to a stretching of the damp sheet in the printing nip. As a result, the printed image transferred to the sheet becomes wider from printing unit to printing unit. In order words, the shrunken printing is caused by various factors of moisture and pressure in the individual printing units. In particular, succeeding printing units print seemingly narrower in relation to the preceding printing units.

By so-called swollen printing, there is understood to be an appearance in the sheet offset print that a line extending vertically to the printing direction, which is printed in a printing unit of a sheet-fed offset printing press and thus transferred to the printed product, is not parallel to a corresponding line which was printed in a succeeding printing unit, but rather, has a round or curved course, with a maximum deviation in the middle of the sheet. The cause for the swollen printing resides in a sagging or bending of the gripper systems of the paper-guiding cylinders. Because the gripper systems and cylinders are supported laterally, they experience maximum deflection of the bending line thereof in the middle of the printing press. This effect becomes especially serious in half-revolution cylinders, i.e., in cylinders with twice or double the conventional circumference of printing-unit cylinders because, with such cylinders, the extent of sagging of the respective cylinder, and the concave or convex deformation of the printed product associated therewith, has double the effect.

If the many transfer points in a multicolor printing press are taken into account, it becomes clear what great significance can be ascribed to devices which are capable of compensating for deviations in register caused by so-called shrunken and swollen printing.

From the published German Patent Document DE 41 19 824 C1, an especially constructed cylinder has become known which compensates for the sagging of the cylinder caused by its own weight, and the compressive strain and the drive forces applied thereto. In particular, the cylinder is constructed so that slight sagging can be corrected by an adjusting device. Correction of the leading edge of cylinder-guided sheets in the concave or convex direction can be effected both retroactively and while the printing press is in operation.

In the case of a further sheet compensator which has become known heretofore, a gripper bar is of multipartite construction, and the various parts thereof are positionable individually. With gripper bars having this type of construction, not only a convex or concave deformation but also shrunken printing on a printed product printed in the press can be compensated for. Typically, adjustment of the gripper bars is effected by trial and error, that is, attaining the OK state is greatly dependent upon the skill of the pressman.

SUMMARY OF THE INVENTION

Departing from this state of the prior art, it is an object of the invention of the instant application, to provide a device for compensating for deviations in register in printed products and which enables automatic adjustment of sheet compensators.

With the foregoing and other objects in view, there is provided, in accordance with one aspect of the invention, a device for compensating for deviations in register in a printed product produced in a sheet-fed rotary printing press having a plurality of printing units, comprising at least one opto-electrical sensor device for detecting measured values from at least two image regions of a printed product; a computer/control device connected to the sensor device for receiving therefrom data regarding the measured values, for ascertaining from the data deviations in register between color separations caused by shrunken and/or swollen printing transferred to the printed product in the respective printing units, and for determining corresponding compensating adjustment data; and adjusting devices connected to the computer/control device for compensating for the deviations in register between the color separations in accordance with the determined adjustment data of the computation/control device.

In accordance with another feature of the invention, the opto-electrical sensor device is an off-line register measuring instrument.

In accordance with a further feature of the invention, the opto-electrical sensor device is a register measuring instrument disposed in the printing press.

In accordance with an added feature of the invention, the opto-electrical sensor device is an on-line or off-line image detection device for delivering image data of the printed product.

In accordance with an additional feature of the invention, the respective detected image region is located inside a subject of the printed product.

In accordance with a concomitant feature of the invention, the respective image region is located within a subject-free zone of the printed product wherein registration marks are disposed.

In accordance with another aspect of the invention, there is provided a method of compensating for deviations in register in printed products produced in a sheet-fed rotary printing press having a plurality of printing units, which comprises detecting measured values from at least two image regions of a printed product with at least one opto-electrical sensor device; delivering data regarding the measured values from the sensor device to a computer/control device; ascertaining in the computer/control device, from the delivered measured-value data, deviations in register between color separations caused by shrunken and/or swollen printing transferred to the printed product in the respective printing units, determining in the computer/control device corresponding compensating adjustment data; and delivering the compensating adjustment data to adjusting devices for compensating for the deviations in register between the color separations in accordance with the determined adjustment data.

Thus, the object of the invention is attained by a device having the following components: at least one opto-electrical sensor device, which detects measured values from at least two image regions of the printed product; a computer/control device which, from the measured data, ascertains deviations in registration between the color separations on the printed product, and deviations caused by shrunken printing and/or swollen printing, and determines corresponding compensating adjustment data; and adjusting devices, which compensate for the deviations in registration in accordance with the ascertained adjustment data of the computer/control device.

In an advantageous feature of the device according to the invention, the opto-electrical sensor device is an off-line register measuring instrument. A suitable offline register measuring system is described in published German Patent Document DE 37 19 766 C2. An encoded register mark is optically surveyed on a color-matching table by a handheld measuring instrument. The register mark has a special shape; it is formed of two straight lines disposed at right angles to one another and intersecting one another; the intersection of the straight lines defines the center of a circle. Other sets of lines extend parallel to the two straight lines. Register errors are determined from deviations of the sets of lines from a reference set of lines. Next, correction data are transmitted to the corresponding register adjusting devices.

On-line register measuring systems are more expensive to make than off-line measuring systems, but they do have the advantage that register errors which occur can very quickly be detected and eliminated. The amount of spoiled or waste copies printed can be reduced to a minimum. An alternative embodiment of the device according to the invention of the instant application provides for the use of an on-line measuring register system of this type as an opto-electrical sensor device. A register measuring system suitable for on-line measurement has become known heretofore from published German Patent Document DE 40 14 706 A1. Specially shaped register marks are printed on the printing product and are scanned opto-electrically during travel of the printed product through the printing press.

Furthermore, on-line and off-line register measuring systems have become known heretofore which make use of video technology with image processing in order to detect register differences in a printed image. In published European Patent Document EP 0 221 472 A1, the register difference determination is done interactively and semi-automatically, in that the register crosses, which are recorded by the video camera and shown enlarged on a monitor, are activated by a human operator using a cursor control. An evaluating computer then determines the register difference from the image coordinates.

A register measuring system capable of detecting deviations in register in the subject of the printed product is described in published German Patent Document DE 40 12 608 A1. A color video camera takes a picture of and enlarges a point in the printed image which has a given contour which is produced by a superimposed printing of at least two different ink colors and is detectable in the form of a difference in brightness and/or color. Then, the printed image point taken by the video camera is broken down into the color separation of the ink colors used in printing. The determination of the deviations in register is achieved from the relative offset in the contours in the various color separations.

As noted hereinbefore, the compensating device according to the invention is suitable for on-line or off-line determination of deviations in register, depending upon its construction type. It likewise makes it possible, in order to determine the deviations in register, to utilize regions inside the subject of the printed image, or selectively or exclusively to use regions outside the subject which contain specially formed register marks. In particular, to detect shrunken printing, two register marks are provided in the regions of the sides of the leading edge of the sheet forming the printed product. In order to detect deviations in register from a concave or convex curvature of the sheet, which causes what is known as swollen printing, a centrally disposed register mark in the region of the leading edge of the sheet which is free of a printed image is additionally provided.

Other features which are considered as characteristic for the invention are set forth in the appended claims.

Although the invention is illustrated and described herein as embodied in a device for compensating for deviations in register in printed products, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIGS. 5A, 5B and 5C constitute a flow chart illustrating sequential steps in the operation of a computing/regulating device forming part of the invention.

DESCRIPTION OF THE PREFERRED EMBODIMENT

Figure 1:
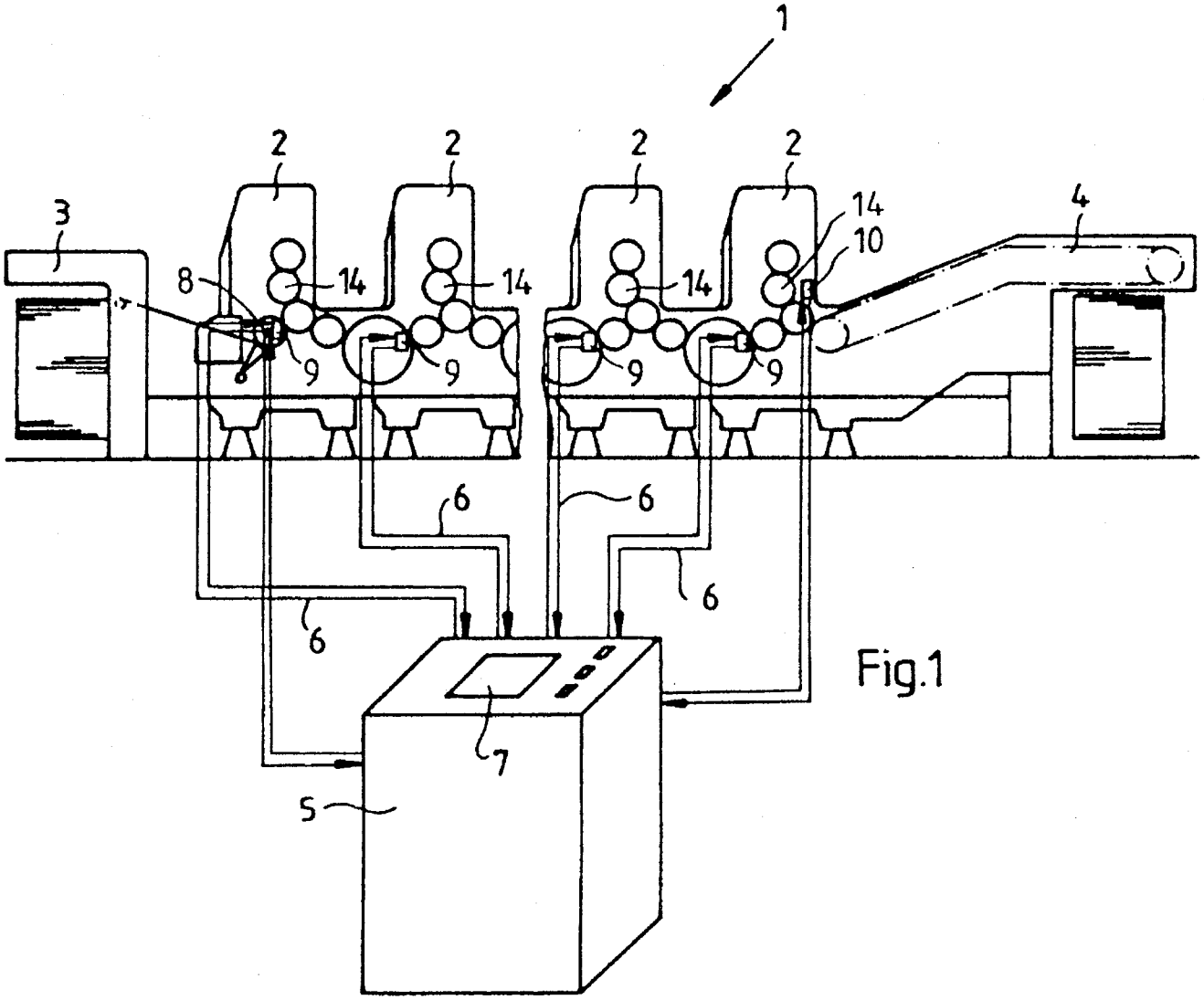
FIG. 1 is a schematic and diagrammatic side elevational view, partly in perspective, of a device according to the invention used on-line with a sheet-fed rotary printing press.

Referring now to the drawing and, first, particularly to FIG. 1 thereof, there is shown therein an embodiment of the device for compensating for deviations in register in printed products according to the invention in an on-line use in a sheet-fed rotary printing press 1, i.e., deviations in register which occur in a printed image are measured directly in the printing press 1 and compensated for via a suitably applied regulating or closed-loop control process. The additional effort and expense necessary in this case for synchronizing the measured values with the printed product traveling through the printing press is justified by the very rapid elimination of deviations in register. In on-line regulation or closed-loop control of problematic factors, the printing of waste or spoiled copies can be reduced to a minimum.

FIG. 1 shows a printing press 1 with several printing mechanisms 2, a feeder 3, and a delivery 4. A printed product 11 is printed with color separations in the various printing units as it travels though the press 1.

Advantageously, an opto-electrical sensor device 10 is assigned to an impression cylinder of the last printing unit 2, counting from the feeder 3. This opto-electrical sensor device 10 is either a register measuring instrument or an image acquisition or picture-taking device such as a color video camera. A suitable color video camera is described in published European Patent Document EP 0 143 744 A1. The opto-electrical sensor device 10 transmits measured data to the computer/control device 5 which, from these measured data ascertains deviations in register with respect to shrunken printing and/or swollen printing. The deviations in register are determined with respect to a set color, typically "black". The correction data required to compensate for the shrunken and/or swollen printing are transmitted by the computation/control device to adjusting devices 9, namely sheet compensators. As described hereinbefore, these sheet compensators 9 deform the product to be printed beforehand in such a way that the ensuing shrunken printing and/or swollen printing does not occur. In particular, such sheet compensators may also be provided beforehand in the region of the feeder 3 of the printing press 1.

Figure 2:
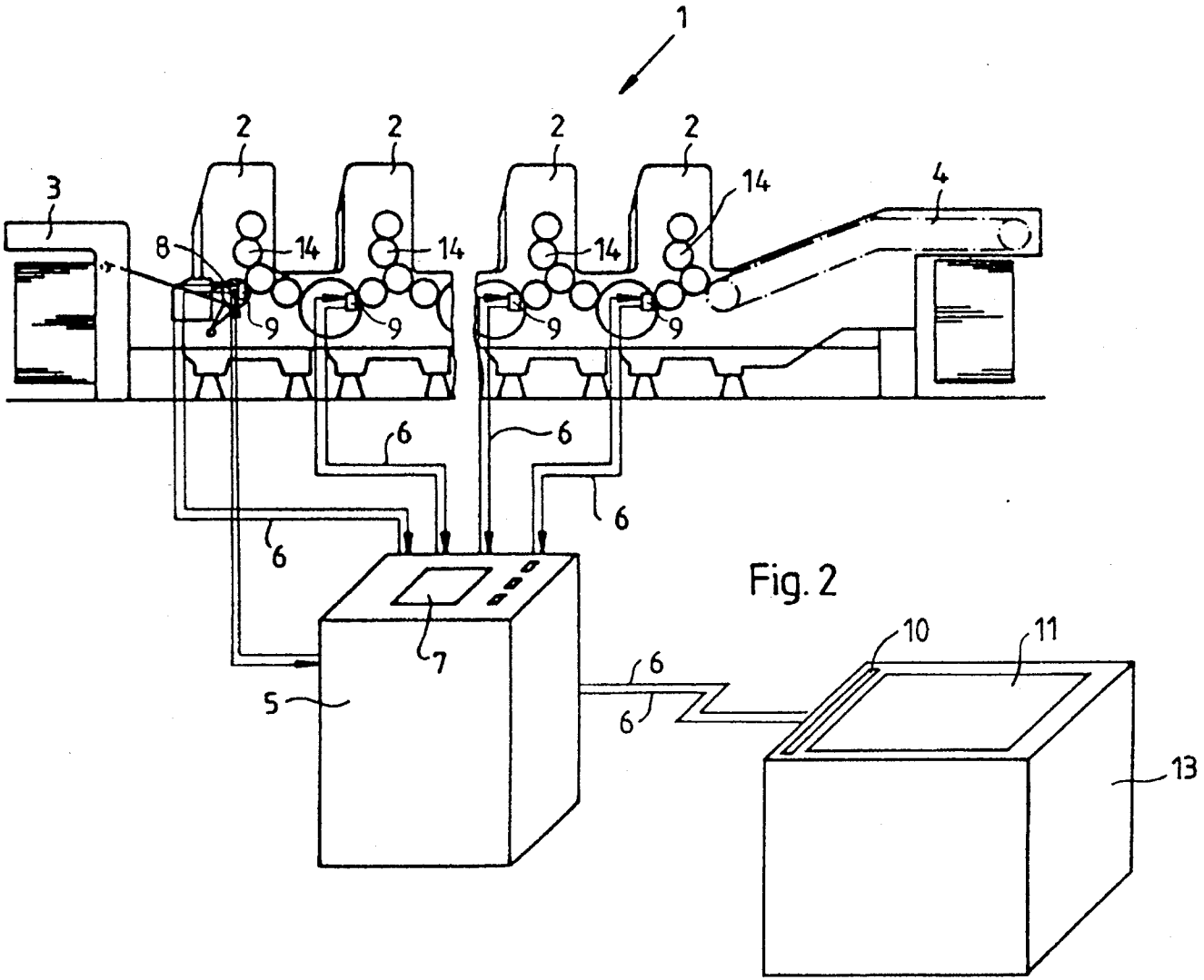
FIG. 2 is a view like that of FIG. 1 wherein the device according to the invention is installed off-line.

FIG. 2 shows another embodiment of the device according to the invention in an off-line installation. The measured data, in this embodiment, are ascertained from a printed product 11 which is positioned on a color-matching table 13. Once again, the opto-electrical sensor device 10 may either be a register measuring instrument or a color video camera. The opto-electrical sensor device 10 is positioned either manually or automatically with respect to the selected regions. The instant the measured data indicate that deviations in register are occurring as a consequence of shrunken and/or swollen printing in the selected regions, the computer/control device 5 transmits or conducts the appropriate compensating adjusting data to the adjusting devices 9.

Figure 3A:
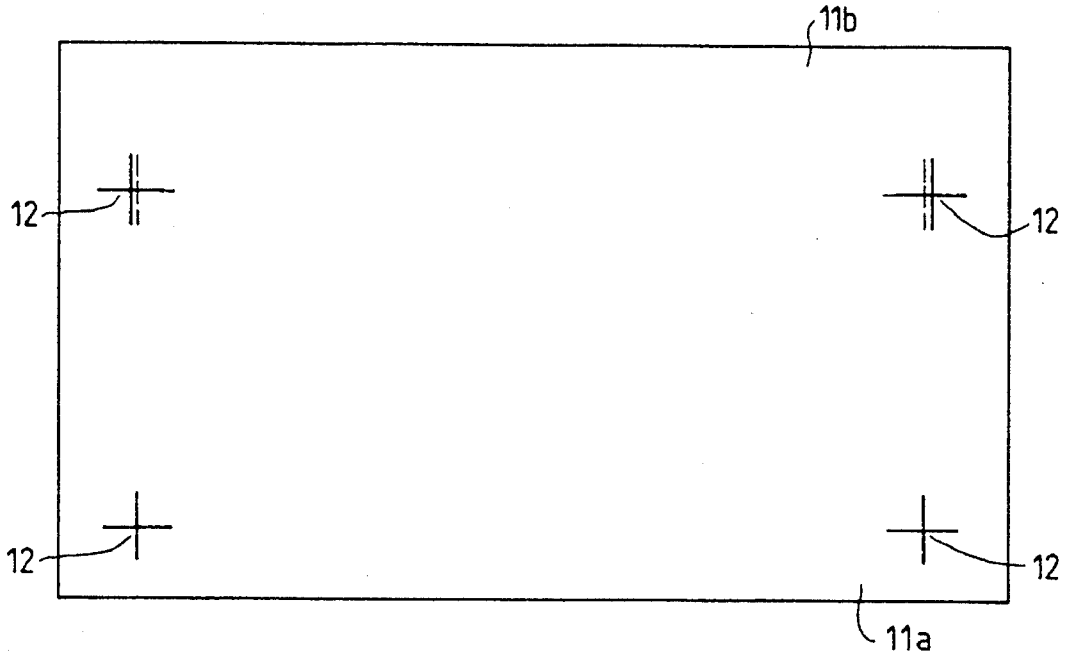
FIGS. 3*a*, 3*b*, 4*a* and 4*b* are plan views of printed products in the form of sheets having an advantageous disposition of printed register marks thereon.
Figure 3B:
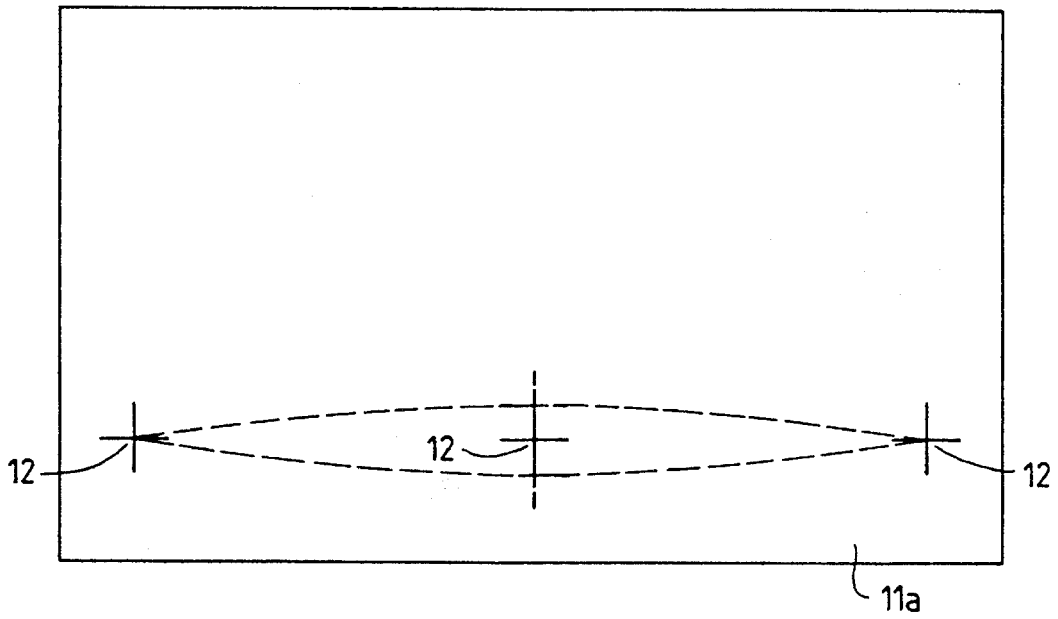

FIGS. 3*a* and 3*b* illustrate arrangements of register marks on a printed product 11 in accordance with an advantageous feature of the device of the invention. Three register marks 12 are provided in the region at the beginning or leading portion of the sheet forming the printed product 11. When in-register printing takes place, the register marks 12 rest precisely above one another in the various printing units 2. When deviations in the register occur, a relative spacing occurs between the register marks 12 in the different individual ink colors.

The consequences of the so-called shrunken printing are visible from the two register marks 12 on the sides of the sheet or printed product 11 in FIG. 3*a*. The printing product 11 is printed (with solid lines) in the first printing unit 2 following the feeder 3 in FIGS. 1 and 2. While the printed image in the region of the leading edge 11*a* of the sheet is transferred from a rubber blanket cylinder 14 onto the printing product 11 without any lateral stretching, the printing product stretches outward in the regions of the trailing edge 11*b* of the sheet. The cause for this resides in the dampening of the printing product 11 and/or in the force conditions which prevail in the printing zone. After the printed printing product 11 leaves the printing zone, it shrinks, but not down to its original printed width; the register marks 12 are therefore farther apart at the trailing edge 11*b* of the printed product 11 than at the leading edge 11*a* of the printed product 11. When the second ink color (broken lines) is imprinted, once again, a stretching of the printed product 11 occurs. However, the stretching of the printed product 11 is somewhat less in this second pass. The register marks 12 of the second ink color are therefore located inside the register marks 12 of the first ink color. These processes are repeated in all the ensuing printing operations until such time as the printed material has come to rest. The register marks 12 of the last color printed are located inside all the previously printed register marks 12 of the other colors, in the region of the leading edge of the printed product 11.

Additional deviations in register occur due to the sagging of the respective cylinder carrying a sheet. This situation is shown in FIG. 3*b*. To enable the detection of deviations in register due to swollen printing (convex or concave displacement of the relative position of the register marks 12), one additional register mark 12 is disposed nearly in the middle between the two lateral register marks 12. If this centrally disposed register mark 12 shifts relative to an imaginary line connecting the two lateral register marks 12, then the register deviation caused by the swollen printing can be determined by simple calculations.

Figure 4A:
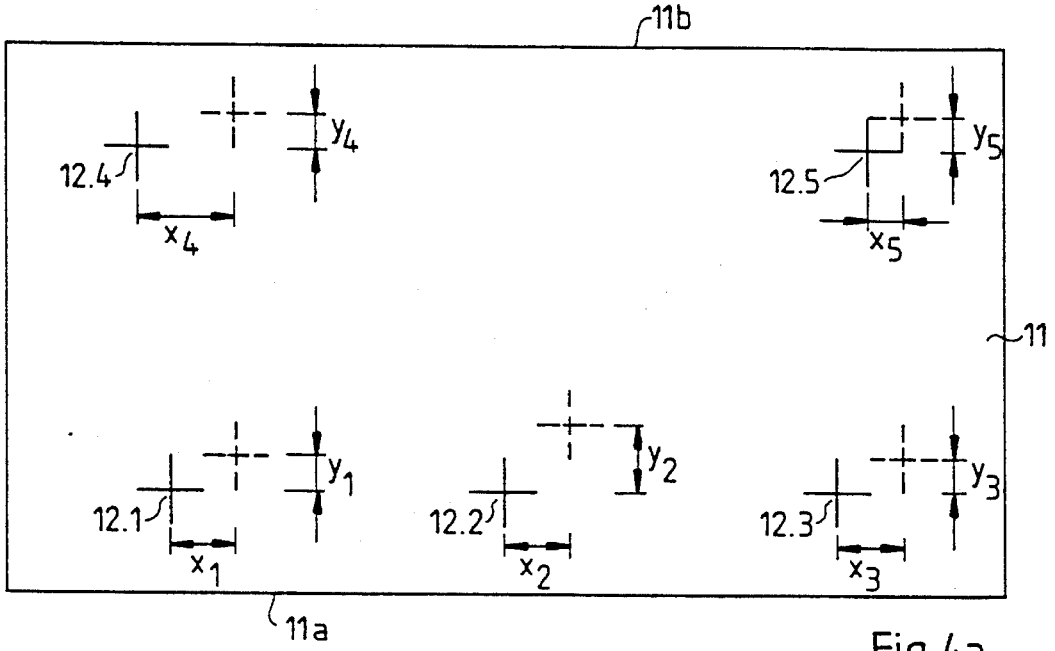
Figure 4B:
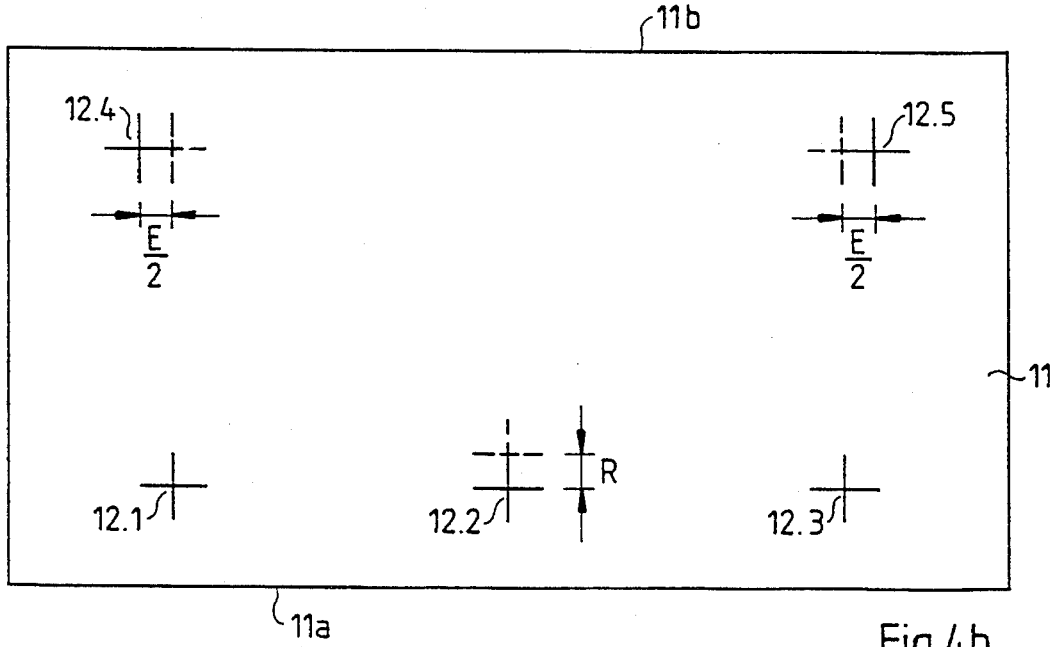
Figure 5A:
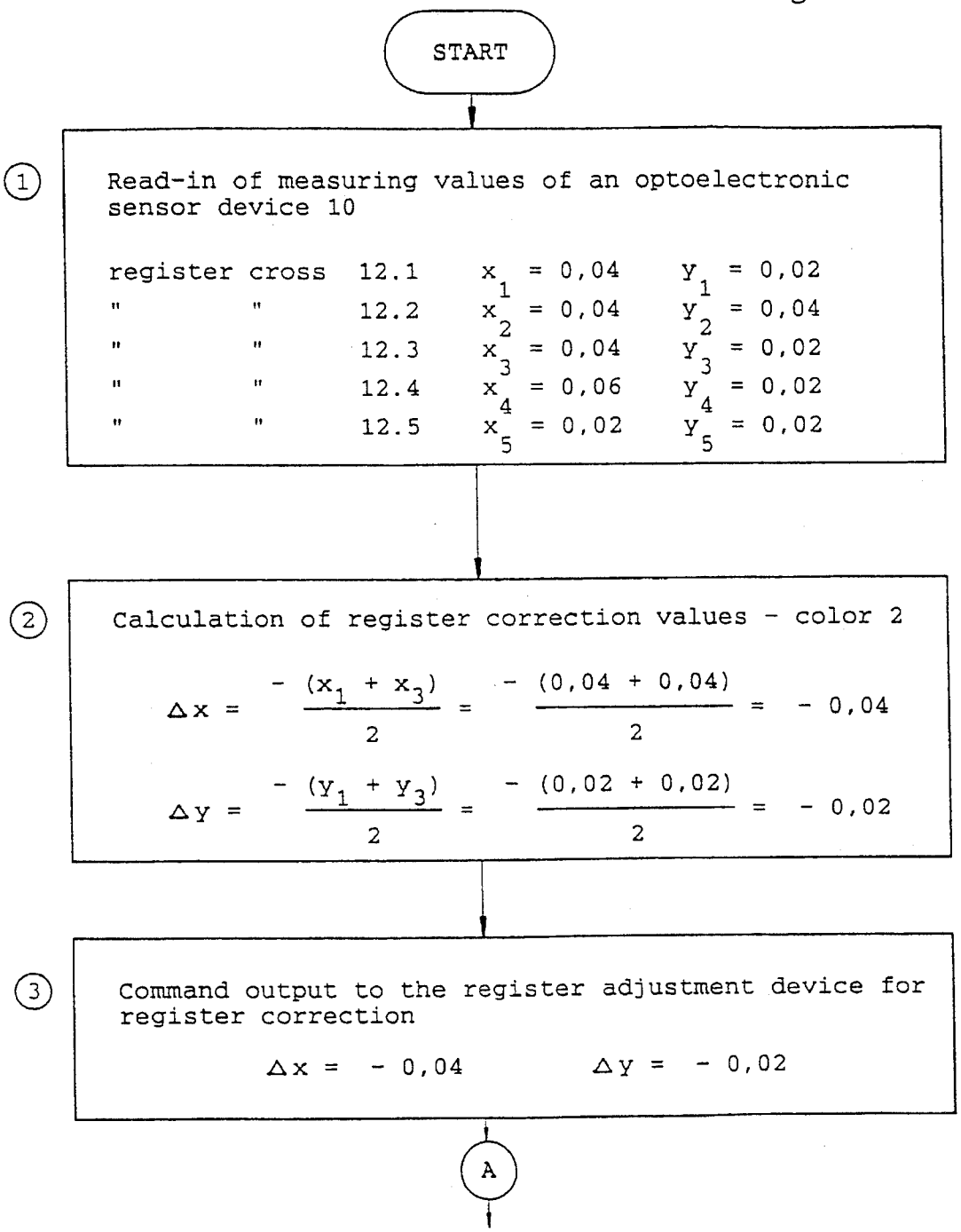

FIGS. 4*a* and 4*b* also show arrangements on a printed product of register marks 12.1 to 12.5 which serve as examples for the flow chart of FIGS. 5A to 5C which illustrate the operations of the computer/regulating device 5. The flow chart of FIGS. 5.1 to 5.3 contain the operating steps of the computer/regulating device 5 for obtaining setting data for the sheet compensator device 9 in a two-color sheet-fed printing press. If the printing press prints with more than two colors, all of the operating steps depicted in the flow chart are repeated for each additional color. As noted hereinbefore, the sheet compensator 9 is an adjusting device which enables a transported sheet to be compressed or stretched a specified amount in order to compensate for register errors caused by the undesirable shrunken or narrow printing and swollen or concave printing.

For a better understand of the operating steps of the flow chart, the calculations shown therein are to be applied to the features shown in FIGS. 4*a* and 4*b*. In this regard, particular attention is drawn to the following steps of the flow chart illustrated in FIGS. 5.1, 5.2 and 5.3:

Step 1 is directed to the operation relating to FIG. 4*a*.

Step 4 is directed to the operation relating to FIG. 4*b*.

Step 6 makes reference to a function $V_R(R)$ which depends upon the type of construction of the sheet compensator device 9 and is stored in memory. The computer calculation shown by way of example in the flow chart relates to $V_R=2$.

Step 8 makes reference to a function $V_E(E)$ which also depends upon the type of construction of the sheet compensator device 9 and is likewise stored in memory. In the calculated example shown in FIG. 5C, $V_E=4$.

I claim:

1. Device for compensating for deviations in register in a printed product produced in a sheet-fed rotary printing press having a plurality of printing units with printing forms, comprising at least one opto-electrical sensor device for detecting measured values from at least two image regions of a printed product, the measured values providing information regarding deviations in register in a printing direction, transversely to the printing direction, and diagonally across the printed product; a computer/control device connected to said sensor device for receiving therefrom data regarding the measured values, for ascertaining from said data deviations in register between color separations, and for determining corresponding compensating adjustment data; and adjusting devices in the printing units connected to said computer/control device for compensating for the deviations in register between said color separations in the printing direction, transversely to the printing direction, and diagonally across the printed product, by shifting a respective printing form in accordance with said determined adjustment data of said computer/control device; said sensor device including means for obtaining measured values from at least two regions on the printed product located transversely offset relative to one another representing deviations in register caused by shrunken and/or swollen printing transferred to the printed product in the respective printing units; and a sheet compensator device connected to said computer/control device effecting a deformation of the printed product for compensating for deviations in register caused by shrunken and/or swollen printing.

2. Compensating device according to claim 1, wherein said opto-electrical sensor device is an off-line register measuring instrument.

3. Compensating device according to claim 1, wherein said opto-electrical sensor device is a register measuring instrument disposed in the printing press.

4. Compensating device according to claim 1, wherein said opto-electrical sensor device is an on-line or off-line image detection device for delivering image data of the printed product.

5. Compensating device according to claim 1, wherein the respective detected image region is located inside a subject of the printed product.

6. Compensating device according to claim 1, wherein the respective image region is located within a subject-free zone of the printed product wherein registration marks are disposed.

7. Method of compensating for deviations in register in printed products produced in a sheet-fed rotary printing press having a plurality of printing units with printing forms, which comprises detecting measured values from at least two image regions of a printed product with at least one opto-electrical sensor device, whereby the measured values provide information regarding deviations in register in a printing direction, transversely to the printing direction, and diagonally across the printed product; delivering data regarding the measured values from the sensor device to a computer/control device; ascertaining in the computer/control device, from the delivered measured-value data, deviations in register between color separations, determining in the computer/control device corresponding compensating adjustment data; and delivering the compensating adjustment data to adjusting devices in the printing units for compensating for the deviations in register between the color separations in the printing direction, transversely to the printing direction, and diagonally across the printed product, by shifting a respective printing form in accordance with the determined adjustment data; and obtaining measured values from at least two regions on the printed product located transversely offset relative to one another representing deviations in register caused by shrunken and/or swollen printing transferred to the printed product in the respective printing units; and effecting a deformation of the printed product with a sheet compensator device for compensating for deviations in register caused by shrunken and/or swollen printing.

* * * * *